US009777740B2

(12) United States Patent
Chiba et al.

(10) Patent No.: US 9,777,740 B2
(45) Date of Patent: Oct. 3, 2017

(54) WATER PUMP

(75) Inventors: Atsushi Chiba, Toyoake (JP); Itsuro Hashiguchi, Chiryu (JP); Megumi Onozuka, Kariya (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 895 days.

(21) Appl. No.: 13/699,266

(22) PCT Filed: Mar. 9, 2011

(86) PCT No.: PCT/JP2011/055522

§ 371 (c)(1),
(2), (4) Date: Nov. 20, 2012

(87) PCT Pub. No.: WO2011/148692

PCT Pub. Date: Dec. 1, 2011

(65) Prior Publication Data

US 2013/0064648 A1 Mar. 14, 2013

(30) Foreign Application Priority Data

May 27, 2010 (JP) ..... 2010-121298

(51) Int. Cl.
*F04D 29/10* (2006.01)
*F04D 29/12* (2006.01)

(52) U.S. Cl.
CPC ..... *F04D 29/126* (2013.01); *F04D 29/106* (2013.01); *F05B 2260/603* (2013.01)

(58) Field of Classification Search
CPC . F04D 29/126; F04D 29/106; F05B 2260/603
See application file for complete search history.

(56) References Cited

U.S. PATENT DOCUMENTS 6,638,015 B2 10/2003 Ozawa et al.
7,704,040 B2 4/2010 Yamazaki et al.
(Continued)

FOREIGN PATENT DOCUMENTS

JP 6-023760 Y2 6/1994
JP 6-48160 Y2 12/1994
(Continued)

OTHER PUBLICATIONS

Notification of Transmittal of Translation of the International Preliminary Report on Patentability (Chapter I or Chapter II)(PCT/IB/338) and International Preliminary Report on Patentability (Form PCT/IB/373) and the Written Opinion of the International Searching Authority (Translation),issued on Mar. 9, 2011, in corresponding International Application No. PCT/JP2011/055522. (8 pages).
(Continued)

*Primary Examiner* — Ninh H Nguyen
*Assistant Examiner* — Brian P Wolcott
(74) *Attorney, Agent, or Firm* — Buchanan Ingersoll & Rooney PC

(57) ABSTRACT

A water pump includes a mechanical seal provided between a housing and a rotary shaft for preventing cooling water from leaking from a whirl chamber. The housing forms a space into which cooling water leaked from between the mechanical seal and the rotary shaft is flown and a water vent for discharging cooling water flown into the space. The housing is joined with a thermostat cover to form a reservoir communicating with the water vent. The reservoir has a drain for releasing evaporated cooling water to the air and a control wall for preventing cooling water remaining as liquid from flowing out through the drain.

16 Claims, 6 Drawing Sheets

(56) References Cited

U.S. PATENT DOCUMENTS

| | | | |
|---|---|---|---|
| 2002/0136633 | A1 | 9/2002 | Ozawa et al. |
| 2007/0025844 | A1 | 2/2007 | Yamazaki et al. |
| 2008/0112792 | A1 | 5/2008 | Hotta et al. |

FOREIGN PATENT DOCUMENTS

| | | | | | |
|---|---|---|---|---|---|
| JP | 11-336699 | A | | 12/1999 | |
| JP | 2002-122100 | A | | 4/2002 | |
| JP | 2002-285998 | A | | 10/2002 | |
| JP | 2002-364585 | A | | 12/2002 | |
| JP | 2002364585 | | * | 12/2002 | ..... F04D 29/08 |
| JP | 2007-016629 | A | | 1/2007 | |
| JP | 2007-032406 | A | | 2/2007 | |
| JP | 2008-121488 | A | | 5/2008 | |
| JP | 2009-293591 | A | | 12/2009 | |

OTHER PUBLICATIONS

International Search Report (PCT/ISA/210) issued on Jun. 14, 2011, by the Japanese Patent Office as the International Searching Authority for International Application No. PCT/JP2011/055522.

Written Opinion (PCT/ISA/237) issued on Jun. 14, 2011, by the Japanese Patent Office as the International Searching Authority for International Application No. PCT/JP2011/055522.

* cited by examiner

WATER PUMP

TECHNICAL FIELD

The present invention relates to a water pump used in cooling an engine, for example.

BACKGROUND ART

Conventionally, a water pump used in a water-cooled engine includes an impeller provided in one end of a rotary shaft supported to a body through a bearing to rotate the impeller for circulating cooling water through the engine. For instance, a water pump disclosed in Patent Document 1 includes a space defined between a mechanical seal and a bearing, in which a few waterdrops entering the space through the mechanical seal are discharged to a reservoir provided in a lower portion of the body through a water vent to allow cooling water to flow out from a drain for establishing communication between the reservoir and the air.

Further, a water pump disclosed in Patent Document 2 includes a groove provided in one side of a reservoir for guiding cooling water, a plug provided in the other side of the reservoir to close the one side of the reservoir, and a drain provided above the plug for establishing communication between the reservoir and the air.

PRIOR ART DOCUMENT

Patent Document

Patent Document 1: Japanese Unexamined Patent Application Publication No. 2002-364585

Patent Document 2: Japanese Unexamined Patent Application Publication No. 11-336699

SUMMARY OF INVENTION

Technical Problem

According to Patent Document 1, the drain is positioned below a confluence between the water vent and the reservoir, which might cause cooling water to flow from the water vent along an inner wall of the reservoir directly into the drain to the outside. Further, since the drain is provided in a joining portion between a housing and a cover, cooling water might flow along an inner wall of the reservoir by capillarity into the drain and then to the outside. If cooling water flows out to the outside, a road surface or parking floor might get wet or an extract from cooling water might be attached to surroundings of the drain disadvantageously.

According to Patent Document 2, since cooling water flows out from a joining portion of the plug along an inner wall of the reservoir by capillarity to the outside through the drain, a road surface or parking floor might get wet or an extract from cooling water might be attached to surroundings of the drain disadvantageously. In addition, use of plug might result in increase in the number of parts and the number or process steps, which disadvantageously raises the overall costs.

The present invention has been made having regard to the above disadvantages, and its object is to provide a water pump for preventing cooling water from flowing out to the outside to wet a road surface or parking floor, preventing an extract from cooling water from being attached to surroundings of a drain, and further reducing both of the number of parts and the number of process steps to lower the overall costs.

Solution to Problem

A first solution according to the present invention is in a water pump comprising a housing; a cover joined with the housing; a rotary shaft formed in joined surfaces of the housing and the cover and projecting to a whirl chamber; an impeller synchronized with the rotary shaft to rotate in the whirl chamber; and a mechanical seal provided between the housing and the rotary shaft for preventing cooling water from leaking from the whirl chamber, in which the housing forms a first space into which cooling water leaked from the mechanical seal flows and a water vent for discharging cooling water which has flowed into the first space, the housing is joined to the cover to form a second space communicating with the water vent in at least one of the housing and the cover, and the second space has a drain for releasing evaporated cooling water to the air and a control wall provided in at least one of the housing and the cover for preventing cooling water remaining as liquid from flowing out through the drain.

A second solution according to the present invention lies in that the second space is divided into two chambers by the control wall, one of which is configured to reserve cooling water flowing in from the water vent, the other of which communicates with the drain, the two chambers communicating with each other.

A third solution according to the present invention lies in that the second space is divided into a chamber and the drain, the chamber and the drain communicating with each other.

A fourth solution according to the present invention lies in that the drain is positioned at a level in the direction of gravity between a confluence of the first space and the water vent and a confluence of the water vent and the second space.

A fifth solution according to the present invention lies in that the drain is smaller than the water vent.

Advantages Effects of Invention

According to the first solution, the control wall provided in the second space prevents cooling water from flowing directly into the drain due to acceleration in all directions during travel of a vehicle or vibrations from an engine, restrains cooling water from flowing out to the outside to wet the road surface or parking floor, and restrains the extract from cooling water from attaching to the surrounds of the drain. In addition, since the housing is joined to the cover to form the second space, a drain plug is dispensable to reduce both the number of parts and the number of process steps to lower the overall costs.

According to the second solution, since the second space is divided into two chambers by the control wall, cooling water is prevented from flowing along a wall of the second space into the drain, and evaporated cooling water can be released from the drain to the air.

According to the third solution, since the second space is divided into the chamber and the drain by the control wall, cooling water is prevented from flowing along the wall of the second space into the drain, and evaporated cooling water can be released from the drain to the air.

According to the fourth solution, since the drain is positioned at the level in the direction of gravity between the confluence of the first space and the water vent and the confluence of the water vent and the second space, cooling water which has flowed into the second space from the water vent is prevented from flowing from the water vent along the wall of the second space into the drain.

According to the fifth solution, evaporated cooling water can be positively discharged to the outside through the drain. Further, the drain is formed to be smaller than the water vent, which effectively restrains liquid cooling water from flowing out to the outside.

DESCRIPTION OF EMBODIMENTS

First Embodiment

Figure 1:
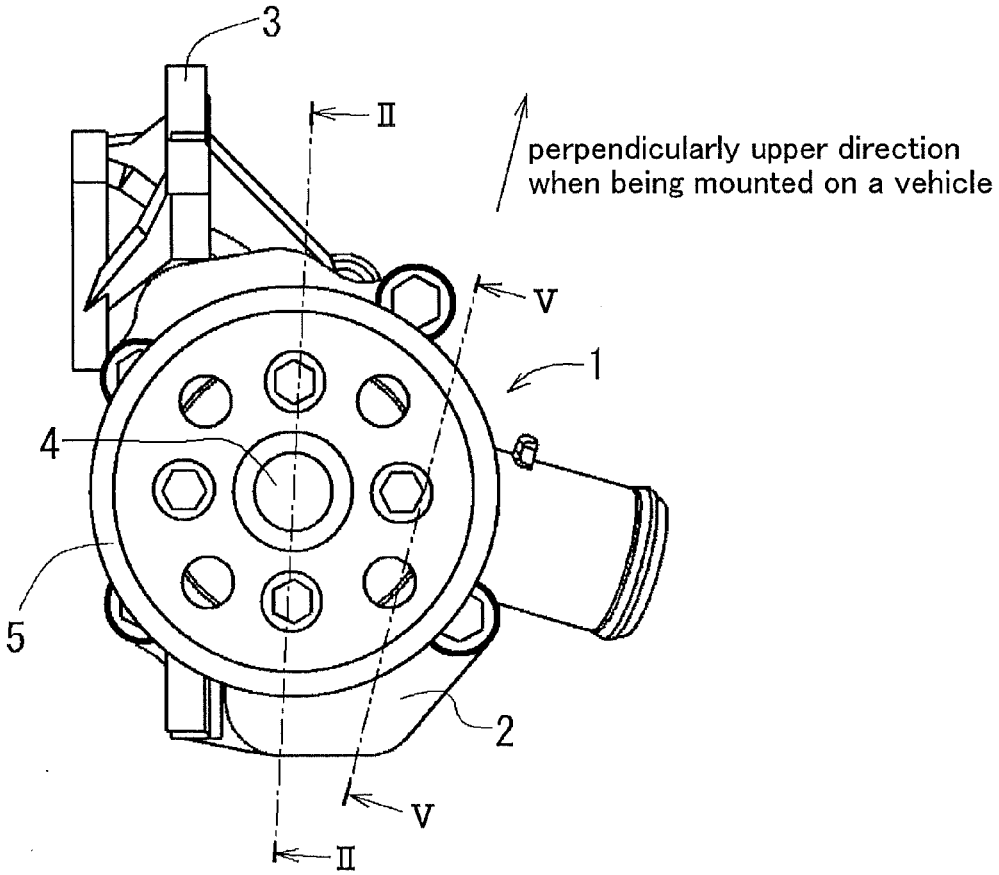
FIG. 1 is a front view of a water pump according to a first embodiment of the present invention.

FIG. 1 is a front view of a water pump 1 including a metal housing 2 molded by forging, for example, a thermostat cover (cover) 3 joined with the housing 2 through a bolt with an unillustrated gasket being held therebetween, and a pulley 5 fixedly bolted to one end of a rotary shaft 4.

Figure 2:
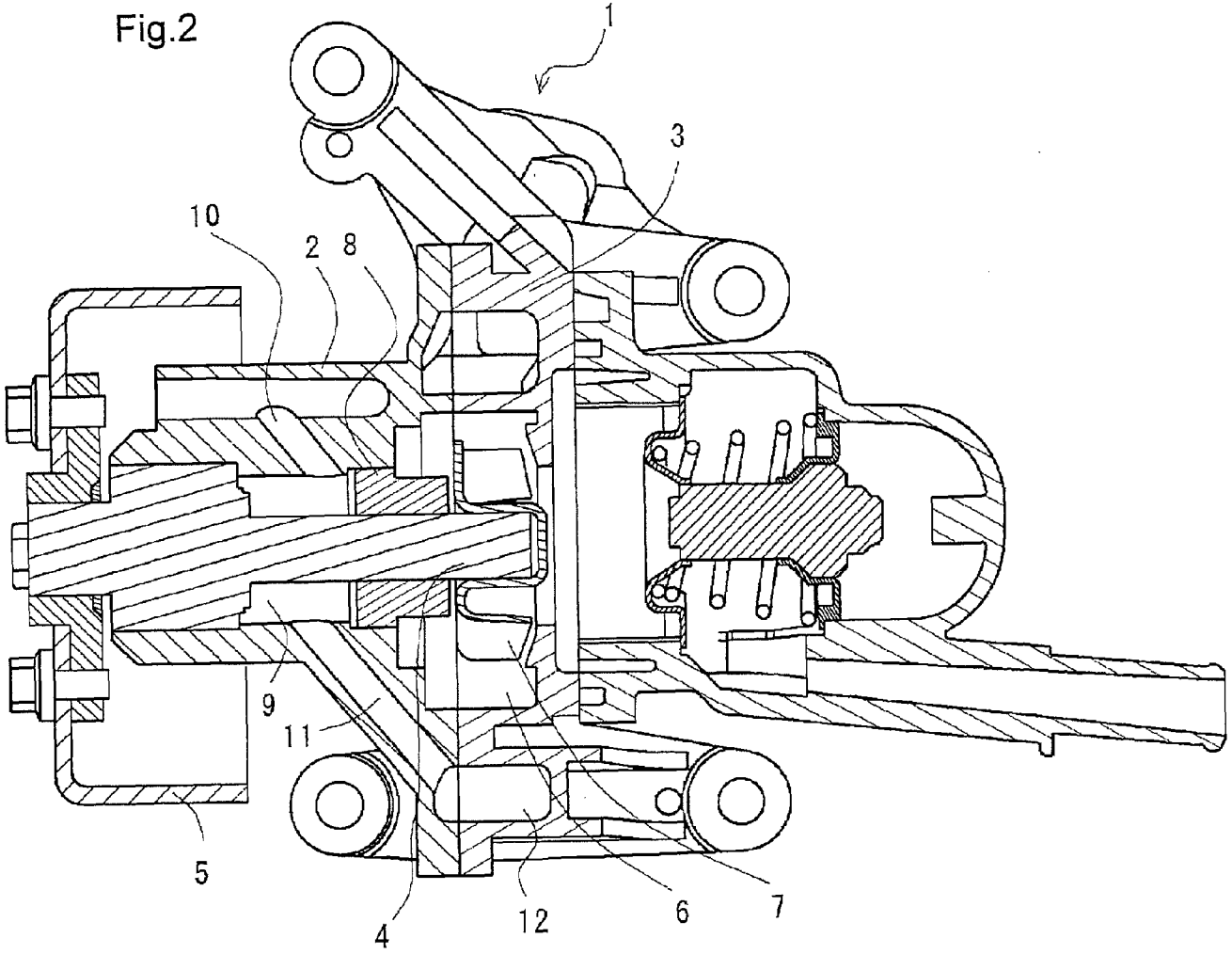
FIG. 2 is a sectional view of the water pump taken on line II-II in FIG. 1 according to the first embodiment of the present invention.

FIG. 2 is a sectional view of the water pump 1 taken on line II-II of FIG. 1. The water pump 1 includes the housing 2, the thermostat cover 3 joined with the housing 2, a whirl chamber 6 formed in joined surfaces between the housing 2 and the thermostat cover 3, the rotary shaft 4 projecting from the housing 2 to the whirl chamber 6, an impeller 7 press fitted to a distal end of the rotary shaft 4 to be synchronized with the rotary shaft 4 to rotate, and a mechanical seal 8 provided between the housing 2 and the rotary shaft 4 for preventing leakage of cooling water from the whirl chamber 6.

Within the housing 2 are formed a space (first space) 9 into which a small amount of cooling water leaked from the mechanical seal 8 flows, a vapor vent 10 for discharging gaseous cooling water which has flowed into the space 9, and a water vent 11 for discharging liquid cooling water which has flowed into the space 9. The water vent 11 communicates with a reservoir (second space) 12 formed in the joined surfaces between the housing 2 and the thermostat cover 3 in the side of the housing 2.

Figure 3:
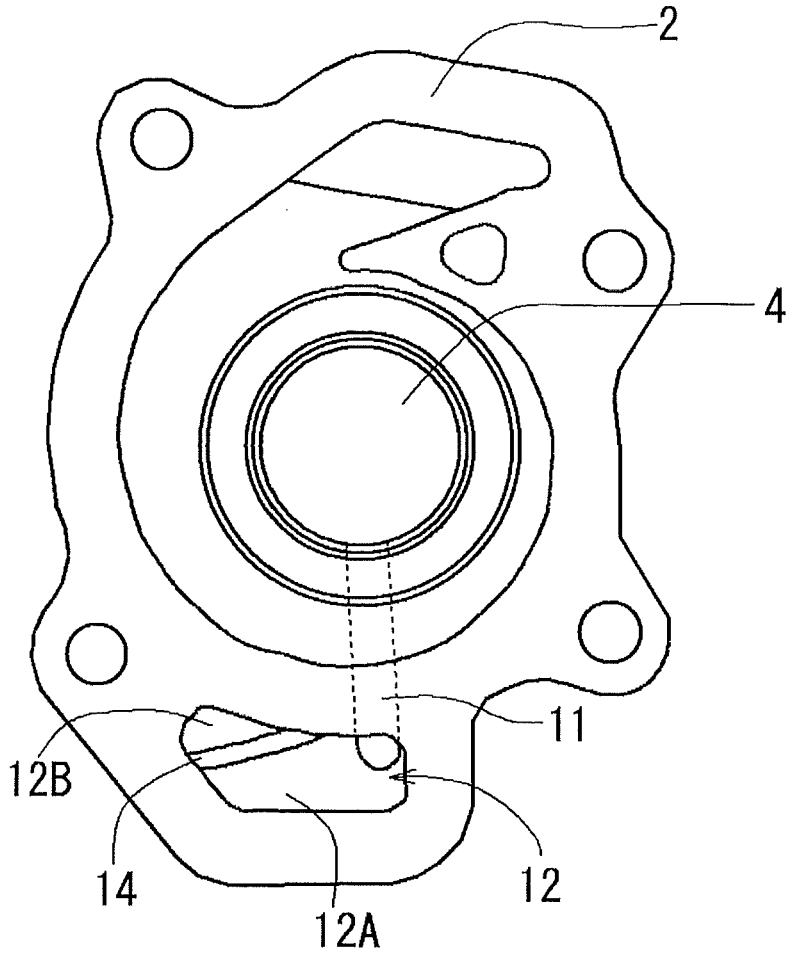
FIG. 3 shows a housing as viewed from a side of a whirl chamber according to the first embodiment of the present invention.

FIG. 3 shows the housing 2 viewed from the whirl chamber 6. The reservoir 12 is divided into two chambers communicated with each other through a control wall 14 provided in a horizontal direction with respect to the gravity. One of the chambers is a chamber 12A formed in a lower portion of the control wall 14 in the direction of gravity, and the other is a chamber 12B formed in an upper portion of the control wall 14 in the direction of gravity. The chamber 12A has a confluence with the water vent 11 and has an area larger than that of the chamber 12B.

Figure 4:
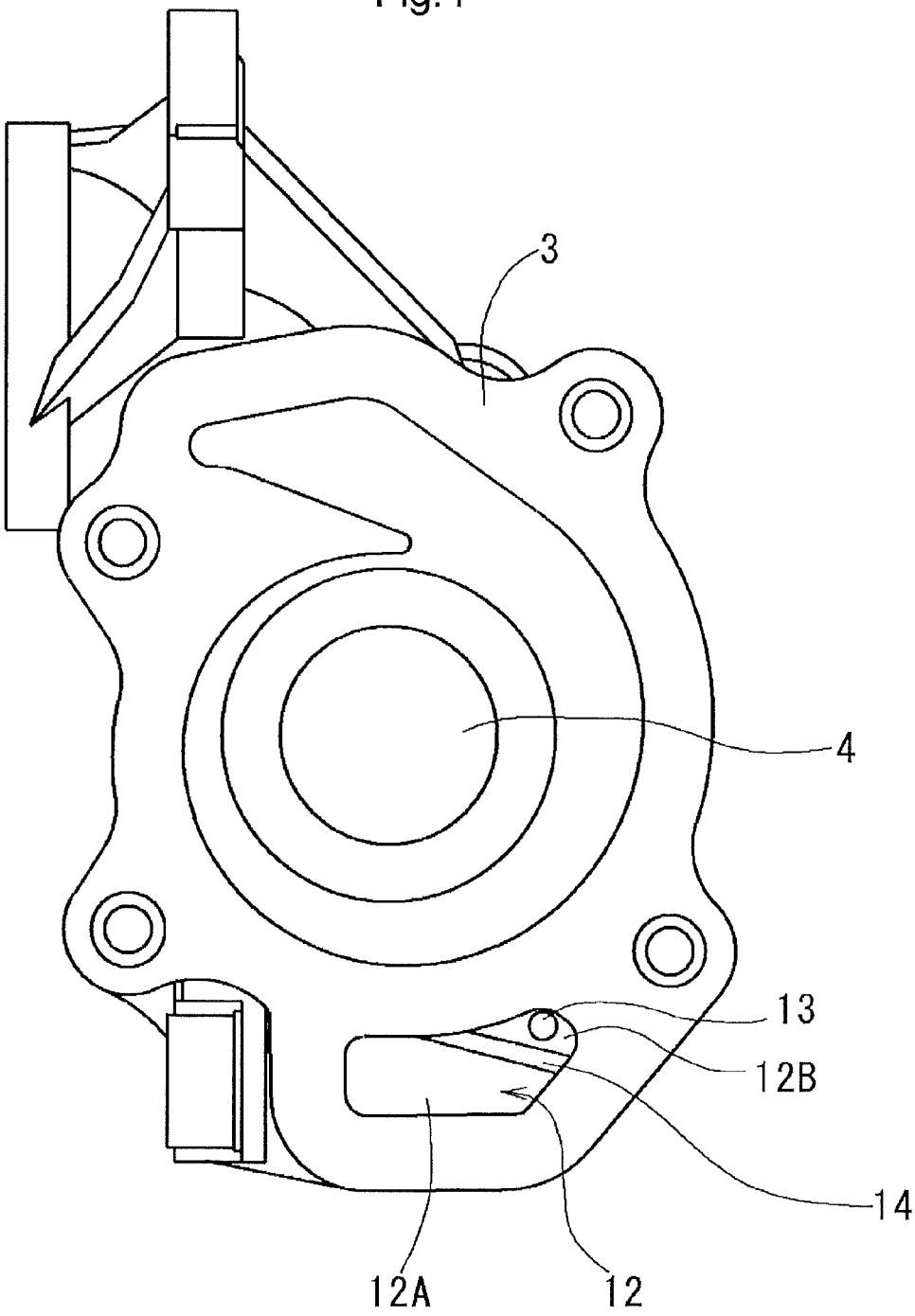
FIG. 4 shows a thermostat cover as viewed from the side of the whirl chamber according to the first embodiment of the present invention.

FIG. 4 shows the thermostat cover 3 viewed from the whirl chamber 6. The reservoir 12 is divided into the two chambers communicated with each other through the control wall 14 provided in the horizontal direction. One of the chambers is the chamber 12A formed in the lower portion of the control wall 14 in the direction of gravity, and the other is the chamber 12B formed in the upper portion of the control wall 14 in the direction of gravity. The chamber 12B communicates with a drain 13 and the area of the chamber 12A is larger than that of the chamber 12B.

The drain 13 is provided below the control wall 14 from the confluence between the space 9 and the water vent 11 and above the control wall 14 from the confluence between the water vent 11 and the reservoir 12 with respect to the direction of gravity. The drain 13 is smaller than the water vent 11.

Figure 5:
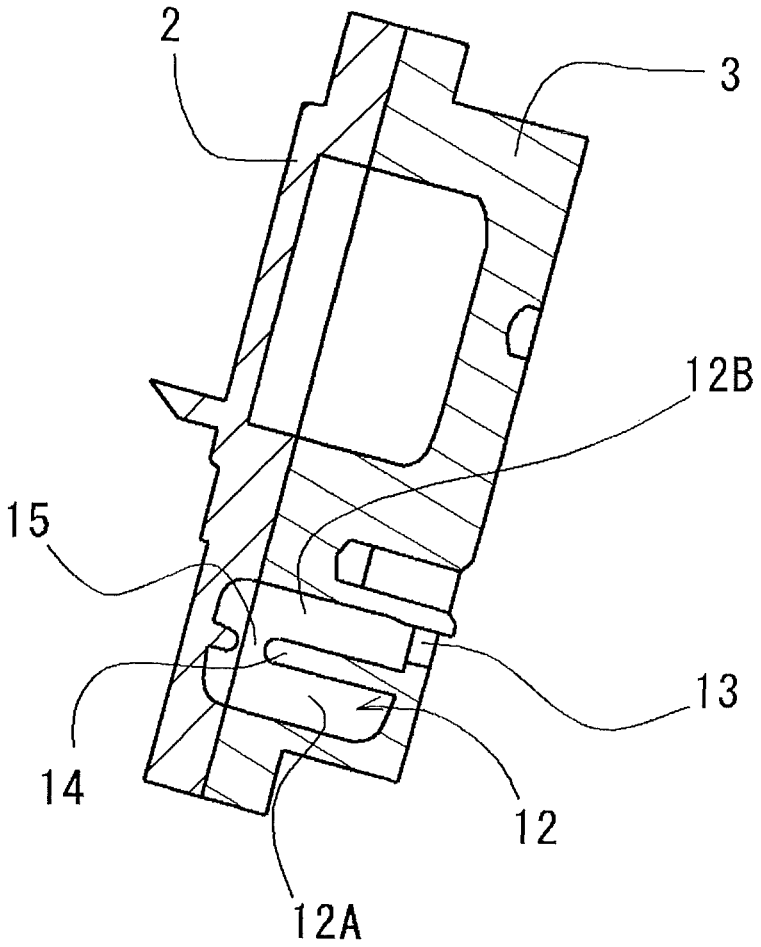
FIG. 5 is a sectional view of the water pump taken on line V-V in FIG. 1 according to the first embodiment of the present invention.

FIG. 5 is a sectional view of the water pump 1 in the first embodiment taken on line V-V of FIG. 1. The control wall 14 projects from both of the housing 2 and the thermostat cover 3 to define a small communicating portion 15 relative to the control wall 14 adjacent to the joined surfaces. The communicating portion 15 allows the chamber 12A and the chamber 12B to communicate with each other. The chamber 12A has a volume larger than that of the chamber 12B.

The operation and effect of the water pump 1 in the first embodiment will be described hereinafter. The rotary shaft 4 is rotated by an unillustrated belt wound around the pulley 5. A sprocket instead of the pulley 5 may be configured to rotate the rotary shaft 4 by a chain. When the rotary shaft 4 is rotated, the impeller 7 is synchronized with the rotary shaft 4 to rotate in the whirl chamber 6, and cooling water is supplied from the water pump 1 to each part of the engine through a water jacket. In this time, a small amount of cooling water flows into the space 9 through the mechanical seal 8, and vaporous or steamy cooling water is discharged through the vapor vent 10 from the space 9 while liquid cooling water flows into the water vent 11 and is guided to the reservoir 12.

Cooling water flows into and is reserved in the chamber 12A provided in the lower part of the reservoir 12 divided into the two chambers in the direction of gravity. Cooling water reserved in the chamber 12A flows along a wall surface of the chamber 12A toward the chamber 12B due to acceleration in all directions during travel of a vehicle and vibrations from the engine, but returned to the chamber 12A by the control wall 14 (acting as what is called a rat guard), which prevents cooling water remaining as liquid from flowing out from the drain 13. Cooling water that has been evaporated again in the chamber 12A flows into the chamber 12B through the communicating portion and is released to the air through the drain 13.

Therefore, a road surface or a parking floor is prevented from getting wet with cooling water, or an extract from cooling water is prevented from being attached to surroundings of the drain.

Further, since the reservoir 12 is formed by joining the housing 2 and the thermostat cover 3, a drain plug is dispensable. Thus, both the number of parts and the number of process steps can be reduced to lower the overall costs.

Second Embodiment

Figure 6:
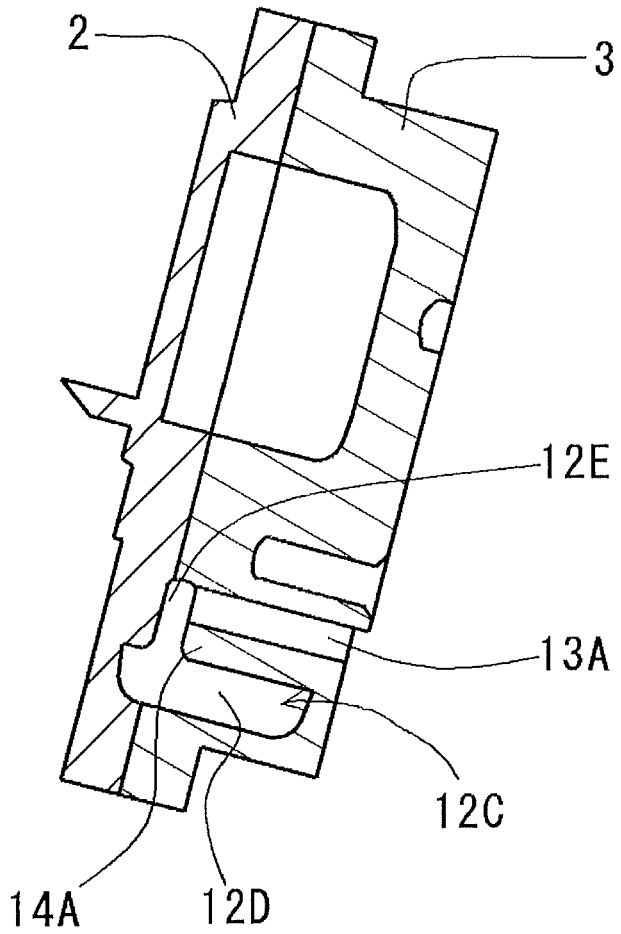
FIG. 6 is a sectional view of the water pump according to a second embodiment of the present invention.

FIG. 6 is a sectional view of a water pump in a second embodiment. The like reference signs used in the first embodiment are assigned to like parts and like arrangements in the second embodiment. A reservoir 12C is divided into a chamber 12D and a drain 13A by a control wall 14A, and is formed by a chamber 12D extending in a horizontal direction with respect to the gravity and a chamber 12E extending perpendicularly to the chamber 12D to form a general inversed T shape. The chamber 12D has a confluence with the water vent 11, the chamber 12E communicates with the drain 13, and the chamber 12D has a volume larger than that of the chamber 12E. In other words, the chamber 12D is provided in one side of the control wall 14 (in the side of the direction of gravity) while the drain 13 is provided in the other side of the control wall 14 (in the side of the upper direction). The chamber 12E is provided in a distal end side of the control wall 14A (opposite side of the drain 13A opened to the outside).

The operation and effect of the water pump in the second embodiment will be described hereinafter. The rotary shaft 4 is rotated by an unillustrated belt wound around the pulley 5. A sprocket instead of the pulley 5 may be configured to rotate the rotary shaft 4 by a chain. When the rotary shaft 4 is rotated, the impeller 7 is synchronized with the rotary shaft 4 to rotate in the whirl chamber 6, and cooling water is supplied from the water pump 1 to each part of the engine through a water jacket. In this time, a small amount of evaporated cooling water flows into the space 9 through the mechanical seal 8, and vaporous or steamy cooling water is discharged through the vapor vent 10 from the space 9 while liquid cooling water flows into the water vent 11 and guided to the reservoir 12.

Cooling water flows into and reserved in the chamber 12D provided in the lower part of the reservoir 12C having a general inversed T shape in the direction of gravity. Cooling water reserved in the chamber 12D flows along a wall surface of the chamber 12D toward the chamber 12E due to acceleration in all directions during travel of a vehicle and vibrations from the engine, but returned to the chamber 12D by the control wall 14 (acting as what is called a rat guard), which prevents cooling water remaining as liquid from flowing out from the drain 13A. Cooling water that is evaporated again in the chamber 12D flows into the chamber 12E through the communicating portion and is released to the air through the drain 13A. Therefore, the road surface or parking floor is prevented from getting wet with cooling water, or the extract from cooling water is prevented from being attached to the surroundings of the drain.

Further, since the reservoir 12 is formed by joining the housing 2 and the thermostat cover 3, a drain plug is dispensable. Thus, both the number of parts and the number of process steps can be reduced to lower the overall costs.

Instead of the thermostat cover 3, any other member such as a timing chain cover or a cylinder block may be joined to the housing 2. Also, a drive source for the water pump 1 may be a motor.

It should be noted that the description "cooling water leaked from the mechanical seal 8" includes not only the situation in which cooling water is leaked from the mechanical seal 8 per se but also the situation in which cooling water is leaked from sliding surfaces between the rotary shaft 4 and the mechanical seal 8.

DESCRIPTION OF REFERENCE SIGNS

1 water pump
2 housing
3 thermostat cover (cover)
4 rotary shaft
5 pulley
6 whirl chamber
7 impeller
8 mechanical seal
9 space (first space)
10 vapor vent
11 water vent
12 reservoir (second space)
12A chamber A
12B chamber B
12C reservoir C (second space)
12D chamber D
12E chamber E
13 drain
13A drain A
14 control wall
14A control wall A
15 communicating portion

The invention claimed is:

1. A water pump comprising:

a housing;

a cover joined with the housing;

a rotary shaft extending through joined surfaces of the housing and the cover and projecting to a whirl chamber;

an impeller synchronized with the rotary shaft to rotate in the whirl chamber; and a mechanical seal provided between the housing and the rotary shaft for preventing cooling water from leaking from the whirl chamber, wherein the housing forms a first space into which cooling water leaked from the mechanical seal flows and a water vent for discharging cooling water which has flowed into the first space, wherein the housing is joined to the cover to form a second space communicating with the water vent, the second space being formed in the joined surfaces of the housing and the cover, wherein the second space has a drain for releasing evaporated cooling water to the air and a control wall integrally formed as a part of at least one of the housing and the cover, and the control wall extending into the second space from at least one of the housing and the cover for preventing cooling water remaining as liquid from flowing out through the drain, and wherein the control wall is in a shape of a plate extending in a horizontal direction with respect to gravity, and an extending length of the control wall into the second space from at least one of the housing and the cover is greater than a thickness of the control wall in a direction perpendicular to a horizontal plane of the control wall.

2. The water pump as defined in claim 1, wherein the second space is divided into two chambers by the control wall, one of which is configured to reserve cooling water flowing in from the water vent, the other of which communicates with the drain, the two chambers communicating with each other.

3. The water pump as defined in claim 1, wherein the second space is divided into a chamber and the drain, the chamber and the drain communicating with each other.

4. The water pump as defined in claim 1, wherein the drain is positioned at a level in the direction of gravity between a confluence of the first space and the water vent and a confluence of the water vent and the second space.

5. The water pump as defined in claim 1, wherein the drain is smaller than the water vent.

6. The water pump as defined in claim 1, wherein the drain passes through a wall which forms a part of the second space, the control wall being integrally formed with the wall which forms the part of the second space and extending into the second space from the wall which forms the part of the second space.

7. The water pump as defined in claim 1, wherein the drain passes through a wall bounding the second space, the control wall being a part of the wall bounding the second space.

8. The water pump as defined in claim 1, wherein the thickness of the control wall in the direction perpendicular to the horizontal plane of the control wall is less than a length of the second space in the direction perpendicular to the plane of the control wall, and the control wall is contiguous to the drain and has a first face facing a part of the second space and a second face located on the opposite side of the first face and facing another part of the second space.

9. A water pump comprising:

a housing;

a cover joined with the housing;

a rotary shaft extending through joined surfaces of the housing and the cover and projecting to a whirl chamber;

an impeller synchronized with the rotary shaft to rotate in the whirl chamber;

a mechanical seal between the housing and the rotary shaft to prevent cooling water from leaking from the whirl chamber;

the housing being configured to form a first space into which cooling water leaked past the mechanical seal flows and a water vent through which is discharged cooling water which has flowed into the first space;

the housing being joined to the cover to form a second space communicating with the water vent, the second space being formed in the joined surfaces of the housing and the cover;

the second space including a drain for releasing evaporated cooling water to the air and a control wall integrally formed as a part of at least one of the housing and the cover at a position so that the second space is located on one side of the control wall and the drain is positioned on an opposite side of the control wall, and the control wall being in a shape of a plate extending in a horizontal direction with respect to gravity, and an extending length of the control wall into the second space from at least one of the housing and the cover being greater than a thickness of the control wall in a direction perpendicular to a horizontal plane of the control wall.

10. The water pump as defined in claim 9, wherein the second space is divided into first and second chambers by the control wall, the first chamber being configured to reserve cooling water flowing in from the water vent, the second chamber communicating with the drain, the first and second chambers communicating with each other.

11. The water pump as defined in claim 9, wherein the second space is divided into a chamber and the drain located on opposite sides of the control wall, the chamber and the drain communicating with each other.

12. The water pump as defined in claim 9, wherein the drain is positioned at a level in the direction of gravity between a confluence of the first space and the water vent and a confluence of the water vent and the second space.

13. The water pump as defined in claim 9, wherein the drain is smaller than the water vent.

14. The water pump as defined in claim 9, wherein the drain passes through a wall which forms a part of the second space, the control wall being integrally formed with the wall which forms the part of the second space and extending into the second space from the wall which forms the part of the second space.

15. The water pump as defined in claim 9, wherein the drain passes through a wall bounding the second space, the control wall being a part of the wall bounding the second space.

16. The water pump as defined in claim 9, wherein the thickness of the control wall in the direction perpendicular to the horizontal plane of the control wall is less than a length of the second space in the direction perpendicular to the plane of the control wall, and the control wall is contiguous to the drain and has a first face facing a part of the second space and a second face located on the opposite side of the first face and facing another part of the second space.

* * * * *